US007174666B2

(12) United States Patent
Fitzpatrick

(10) Patent No.: US 7,174,666 B2
(45) Date of Patent: Feb. 13, 2007

(54) INTEGRAL MAGAZINE EXTRACTION EXTENSIONS

(76) Inventor: Richard Mark Fitzpatrick, 1109 Par Rd., Broomfield, CO (US) 80020

( * ) Notice: Subject to any disclaimer, the term of this patent is extended or adjusted under 35 U.S.C. 154(b) by 0 days.

(21) Appl. No.: 10/245,954

(22) Filed: Sep. 17, 2002

(65) Prior Publication Data

US 2003/0066227 A1 Apr. 10, 2003

Related U.S. Application Data

(62) Division of application No. 09/504,646, filed on Feb. 14, 2000, now Pat. No. 6,481,136.

(51) Int. Cl.
*F41A 9/25* (2006.01)

(52) U.S. Cl. ..... 42/50; 89/33.1

(58) Field of Classification Search ..... 42/7, 42/18, 22, 49.01, 50; 89/33.1
See application file for complete search history.

(56) References Cited

U.S. PATENT DOCUMENTS

| | | | | |
|---|---|---|---|---|
| D33,384 | S | | 10/1900 | Thorne |
| 1,245,499 | A | | 11/1917 | Orme |
| 1,797,951 | A | | 3/1931 | Gaidos |
| 2,205,967 | A | | 6/1940 | Wise |
| 2,825,991 | A | | 3/1958 | Stadelmann |
| 3,191,332 | A | * | 6/1965 | Ardolino |
| 4,008,968 | A | * | 2/1977 | Hobbs ..... 401/207 |
| 4,442,962 | A | * | 4/1984 | Musgrave ..... 42/90 |
| 4,754,689 | A | * | 7/1988 | Grehl ..... 89/196 |
| 4,831,761 | A | * | 5/1989 | Kulakow ..... 42/7 |
| 5,384,980 | A | * | 1/1995 | Johnson et al. |
| 5,566,487 | A | * | 10/1996 | Vaid et al. ..... 42/7 |
| 5,906,065 | A | | 5/1999 | Pearce |
| 6,212,815 | B1 | | 4/2001 | Fitzpatrick |
| 6,481,136 | B1 | * | 11/2002 | Fitzpartick ..... 42/50 |

FOREIGN PATENT DOCUMENTS

| | | | |
|---|---|---|---|
| GB | 3220 | | of 1907 |
| GB | 1434300 | * | 5/1976 |

* cited by examiner

*Primary Examiner*—Stephen M. Johnson
(74) *Attorney, Agent, or Firm*—Geoffrey E. Dobbin

(57) ABSTRACT

Integral extensions to aid in the extraction of ammunition magazines from ammunition pouches are provided by permanently attaching a handle to existing or modified floor plates. In one embodiment, a substitute floor plate is molded with a handle projecting from its outer face. In a second embodiment, a handle with a grip and a terminal end is provided with an attachment structure on the terminal end. Floor plates are then either modified by cutting anchoring holes to allow for the attachment of such handles without hindering use in an ammunition magazine or molded with said anchoring holes.

28 Claims, 2 Drawing Sheets

INTEGRAL MAGAZINE EXTRACTION EXTENSIONS

CROSS REFERENCES TO RELATED APPLICATIONS

This application is a divisional application of application Ser. No. 09/504,646, filed on Feb. 14, 2000 now U.S. Pat. No. 6,481,136.

FIELD OF INVENTION

The present invention relates to the fashioning of extensions on ammunition magazines and more particularly to pull-tab handle extensions that are positioned on the floor end of ammunition magazines by either replacing the floor plate or modifying the floor plate in order to aid with both the extraction of said ammunition magazine from ammunition pouches and the insertion into a weapon.

BACKGROUND OF THE INVENTION

The use of loops to aid in the removal of ammunition magazines from a storage compartment is known in the prior art. Likewise, the use of handle attachments or tabs or other extensions to carry ammunition magazines and other objects is also known. These attachments and modifications, while suitable for their individual purposes, are not as suitable for the purpose of this invention, namely providing an extension that is of one piece with an ammunition magazine or with the floor plate of said magazine for the purpose of extraction of said magazine from ammunition pouches worn on the user. For example, the current practice of forming duct tape tabs and cord loops on ammunition magazines; U.S. Pat. No. 6,212,815 to Fitzpatrick; U.S. Pat. No 5,906,065 to Pearce; U.S. Pat. No. 4,442,962 to Musgrave; U.S. Pat. No. 2,825,991 to Stadelmann; U.S. Pat. No. 2,205,967 to Wise; U.S. Pat. No. 1,797,951 to Gaidos; U.S. Pat. No. 1,245,499 to Orme And U.S. Patent No. D-33,384 to Thorn are all illustrative of the prior art.

Currently, in the field, soldiers use either loops of parachute cord attached to ammunition magazines by duct tape or they form tabs by folding duct tape over the butt end of their ammunition magazines. The loops and tabs aid soldiers in the extraction of said magazines from ammunition pouches carried on the user. However, the duct tape tends to wear and often needs replaced. The duct tape also leaves a sticky residue when removed and provides no other benefit other than the increased friction or fastening a pull tab or loop to the ammunition magazine. Soldiers have also extracted the inside portion of a length of parachute cord, leaving the casing, tied said casing together and positioned the formed loop so that it encircles the floor plate of an ammunition magazine before they replaced said floor plate, with the loop, in the magazine. Thus they have formed a loop, extending from the bottom of the magazine. Unlike the "para-cord loops" the handle according to this invention does not move relative to the magazine, allowing for the entire range of benefits of use of the handles with a lower cost than other handle embodiments.

While the aforementioned inventions accomplish their individual objectives, they do not describe an integral extension that is used primarily for the extraction of ammunition magazines from ammunition pouches, as evidenced by the duct tape modifications used in the field. Handle and loop attachments used in the prior art are mainly used for affixing an ammunition magazine to other objects, such as clothing or vehicles. In one of the two cases where handle attachments are used for extraction, the handle is a simple metal wire forming a loop and is not adapted for use in the various positions a user may wear an ammunition pouch. There are also disadvantages with the duct tape modifications, particularly regarding removal and in the amount of slack in a loop of parachute cord. While the Pearce '065 patent discloses replacement of the floor plate, the enhancer is designed for improving the grip a user has on his gun, not the ammunition magazine, and does not disclose any type of handle extension. The Fitzpatrick '815 patent discloses a handle that is attached to an external sleeve, not an integral handle. In this respect, the extensions according to the present invention depart substantially from the usual designs in the prior art. In doing so, this invention provides integral extensions that are primarily designed for the purpose of aiding the extraction of ammunition magazines from pouches worn on the user.

SUMMARY OF THE INVENTION

In view of the foregoing disadvantages inherent in the known types of attachments and grip extensions, this invention provides extensions for use on the base of ammunition magazines. As such, the present invention's general purpose is to provide a new and improved integral extensions that will aid in the extraction of ammunition magazines from pouches worn on the user.

To attain this purpose, the invention has three individual embodiments. The first embodiment essentially comprises a replacement floor plate, typically molded of a hard plastic or metal, with a tab or loop extending from the replacement floor plate, typically molded from a more resilient plastic or thermoplastic compound. The product would be manufactured by using a bifurcated molding process where the floor plate portion would be molded first and the extension would be molded onto the floor plate in a second molding step. Alternatively, the floor plate may be molded or fashioned with at least one anchoring hole and the handle then either injection molded onto the floor plate or pre-molded with at least one anchoring means and mechanically coupled to the floor plate. The second embodiment would require retrofitting all existing floor plates with at least one anchoring hole along the center of their elongated sides or boring a plurality of holes through a floor plate and either injection molding or mechanically coupling a handle onto the floor plate. In the third embodiment, a plastic magazine would be molded with a resilient loop or tab on its base end or a handle may be attached to the base end by mechanical, ultrasonic welding, or adhesive means. This application will focus primarily on replacement floor plates with tab-type handles extending therefrom. A tab-type handle merely extends outwardly from the floor plate and is generally defined by at least two planar surfaces. This is distinguished from a loop-type handle, which would be a handle that, when attached to the floor plate, would be circuitous, i.e. together they form a short cylindrical shape.

These designs have numerous advantages over the prior art. First, the extensions are integral with the magazine and have a lower incidence of grip failure. Second, the instant embodiment is easily replaceable if and when necessary. Third, the standard means of ejection causes the butt end of the magazine to impact the ground. The molded handle portion acts as a shock absorber for the magazine when it is ejected from the rifle and reduces impact damage to the magazine. Fourth, the extensions abut against the lid of the pouch. This abutment effectively anchors the magazine against the pouch lid and reduces noise caused by the rattling of magazines against pouch when the user is moving. Also, different shapes and sizes of handles may be used to obtain maximum benefit for users with specialized uses (e.g. shorter, non-looped handles for those using the invention in heavy brush situations, used of gloves, location of pouch/holder on user, etc.).

The more important features of the invention have thus been outlined in order that the more detailed description that follows may be better understood and in order that the present contribution to the art may better be appreciated. Additional features of the invention will be described hereinafter and will form the subject matter of the claims that follow.

The primary aspect of the present invention is to provide integral extensions for use on ammunition magazines to aid in their extraction from ammunition pouches.

Other aspects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
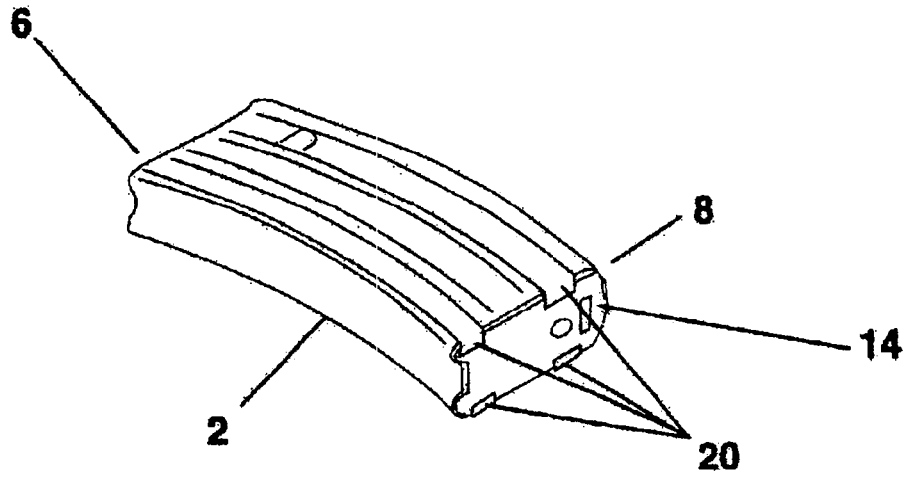
FIG. 1 is a perspective view of a standard M-16 magazine.
Figure 2:
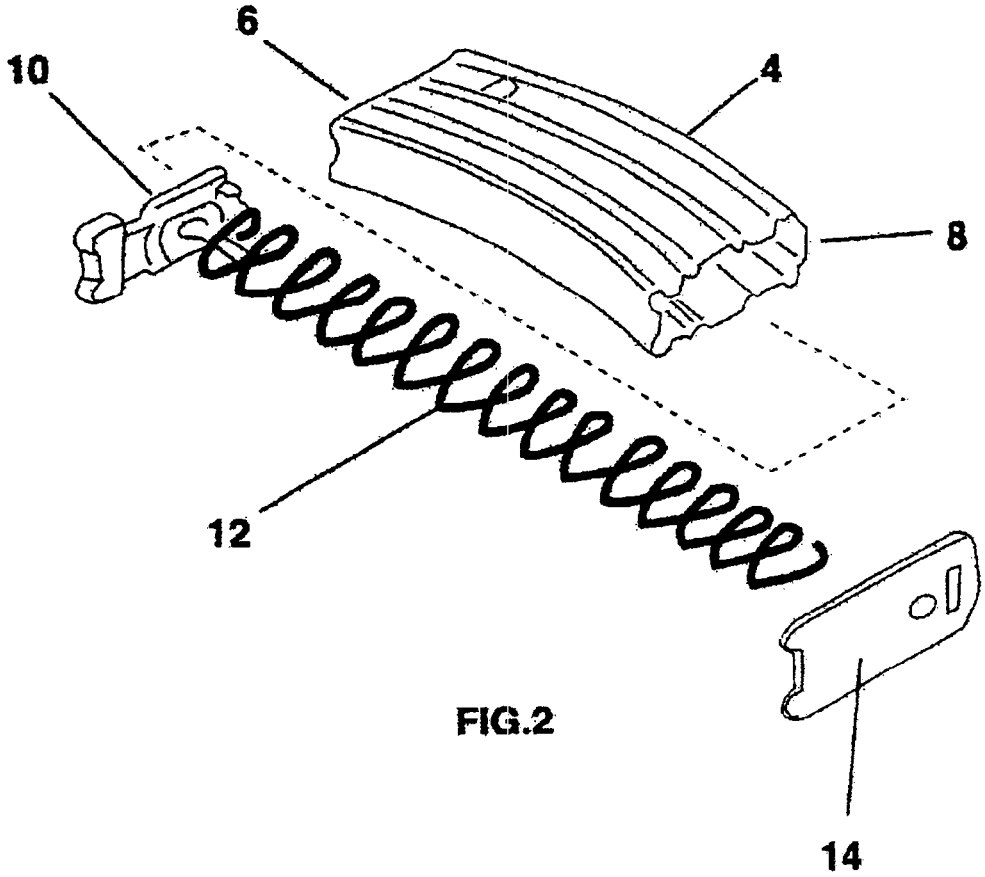
FIG. 2 is an exploded view of the magazine in FIG. 1.
Figure 4:
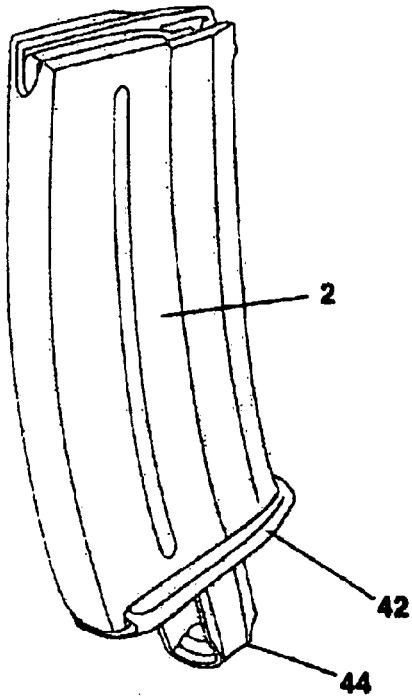
FIG. 4 is a perspective view of a magazine with a sliding type floor plate with the invention installed.

With reference now to the drawings, the preferred embodiment of the new and improved integral extensions for ammunition magazines embodying the principles and concepts of the present invention will be described. Specifically, it will be noted in the figures, especially FIGS. 5 and 6, that the invention relates to the addition of extensions to the floor plate of ammunition magazines and to the addition of similar extensions to the elongated walls of plastic ammunition magazines. Before the invention can be explained, a brief description of the structure of an ammunition magazine, shown in FIGS. 1 and 2, is necessary. The generic magazine 2 is a relatively simple structure. The outer casing 4 is suitably sized and shaped to receive ammunition. The casing 4 has a feed end 6 and a floor, or butt, end 8. The feed end 6 is designed to engage the weapon. Inside the casing, a follower plate 10 is in contact with the follower spring 12, which is in turn, in contact with the floor plate 14. Floor plate 14 is designed to associate with the outer casing 4 of the magazine 2 at its floor end 6 and its individual design will vary with the type of magazine. Floor plate 14 can be said to have a reverse side that, when installed, is on the inside of the magazine, and an obverse side, which is exterior when the floor plate is installed. FIGS. 1 and 2 depict a standard magazine utilizing a tab structure 20 to hold floor plate 14 in place. FIG. 4 depicts a sliding floor plate design. In either design, floor plate 14 is designed to interface with the magazine 2 and substitute floor plates must be similarly designed. When ammunition is loaded into the feed end 6, the follower plate 10 compresses the follower spring 12 against the floor plate 14. This compression is relaxed when a round of ammunition is loaded into the weapon's firing chamber and the spring 12 therefore raises the follower plate 10, and associated ammunition relative to the magazine 2 and weapon. The raising readies the next round of ammunition for loading into the weapon's firing chamber after the first round is used and expelled.

Figure 3:
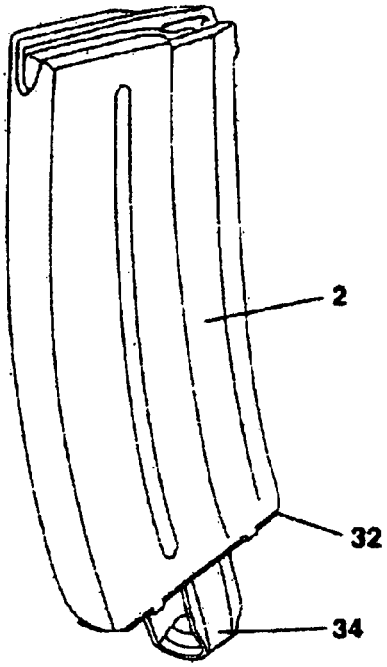
FIG. 3 is a perspective view of the magazine of FIG. 1 with the invention installed.
Figure 5:
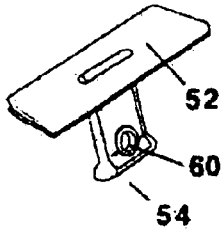
FIG. 5 is a perspective view, as seen from the bottom, of the invention as a standard replacement floor plate.
Figure 6:
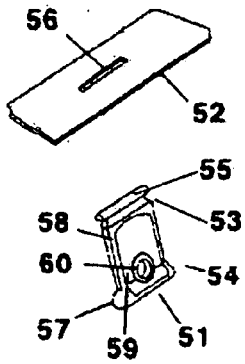
FIG. 6 is an exploded view of the invention, as seen in FIG. 5.

The preferred embodiment of the invention, shown in FIGS. 3 and 4, is a substitute floor plate 32, 42 positioned on the floor end of an ammunition magazine. The floor plate 32, 42 is ideally molded from a rigid plastic or metal, with a handle 34, 44 protruding from said substitute floor plate 32, 42. The handle 34, 44 can be molded onto the substitute floor plate 32, 42 by using a bifurcated molding process where the floor plate 32, 42 is molded from a rigid plastic and the handle 34, 44 is ideally molded from a softer, more resilient material, such as thermoplastic, and attached to the substitute floor plate 32, 42. Referring to FIGS. 5 and 6, the two staged molding process may include either molding the handle 54 directly onto the floor plate 52, so that the handle 54 and floor plate 52 are of one piece, or molding the floor plate 52 with at least one hole 56 and then the handle 54 may be injection molded, onto the floor plate 52. Alternatively, The handle 54 may be molded separately, shown best in FIG. 6 having a grip end 51 and a fastening end 53 on either side of handle body 58. The fastening end should have at least one terminus with at least one anchoring node 55,, and then mechanically coupled to the floor plate 52.

Handle 54 should extend approximately 1.0 to 1.5 inches from the substitute floor plate 52. This will enable the handle 54 to engage the lid of an ammunition pouch. Handle 54 should be some form of tab. The handle 54 in FIG. 5 may be molded with a variety of shapes, including but not limited to ovals, cylinders, knobs, and wedges. No limitation as to shape should be inferred from the drawings. For this variation, a small, reinforced hole 60 should be provided in the handle 54 so that a user may hook the magazine onto a carabineer after ammunition is spent. Roughened recessed areas 59 should be provided within handle body 58. Any recessed areas are determined by the shape of handle body 58. For the version of the handle shown in FIG. 6, recessed areas 59 are provided on the planar faces of the handle body 58. Also, the grip end 51 is molded with a ridge 57 to facilitate gripping the handle 54. As used in this Application, the terms "tab" or "tab-type" refer to the number of terminal ends of the handle that are not connected to the floor plate 52. A "tab" or "non-looped" handle 54 has at least one termnal end, end 51 in the instance shown in FIG. 6, that is not attached to the floor plate 52.

In the second, retrofitting, embodiment, the floor plate 52 is modified to accommodate the attachment of a handle 54. Small holes 56, similar to those molded into the substitute floor plate 54 of the previous embodiment may be bored into a floor plate 52 and a handle 54 either injection molded or mechanically coupled onto the modified floor plate as in the previous embodiment. The attachment means may be affixed to the floor plate 52 with some type of adhesive, such as epoxy or glue, or ultrasonically welded, assuming the floor plate 52 and handle 54 are plastic. The attachment structure should be thin enough to not interfere with the normal operation of the ammunition magazine, that is to say not interfere with the follower spring 12 of FIG. 2, but thick enough to withstand repeated use, usually ¼ inch to ¾ inch.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An extraction extension for ammunition magazines comprising:

a floor plate, having two planar sides, one designated as the obverse side with the other being designated the reverse side; and a handle, protruding from said obverse side of the floor plate for a length between 1 and 1.75 inches, the handle being permanently attached to the floor plate, an end of the handle furthest from the floor plate defined as the top of the handle;

wherein, the handle is a tab-type handle.

2. The extraction extension of claim 1, wherein the handle shape is selected from the set of shapes consisting of: a flat polygonal shape, a wedge, an ellipsoidal shape, a cylinder, and a rectangular solid.

3. The extraction extension of claim 1, wherein at least one hollow is fashioned in the handle, said at least one hollow each defining an interior region.

4. The extraction extension of claim 3, wherein the handle shape is selected from the set of shapes consisting of: a flat polygonal shape, a wedge, an ellipsoidal shape, a cylinder, and a rectangular solid.

5. The extraction extension of claim 3, wherein the interior regions of any hollows are roughened to increase friction.

6. The extraction extension of claim 5, wherein the handle shape is selected from the set of shapes consisting of: a flat polygonal shape, a wedge, an ellipsoidal shape, a cylinder, and a rectangular solid.

7. The extraction extension of claim 5, wherein a hole, suitable for attachment purposes, is fashioned in the handle.

8. The extraction extension of claim 7, wherein the handle shape is selected from the set of shapes consisting of: a flat polygonal shape, a wedge, an ellipsoidal shape, a cylinder, and a rectangular solid.

9. The extraction extension of claim 3, wherein a hole, suitable for attachment purposes, is fashioned in the handle.

10. The extraction extension of claim 9, wherein the handle shape is selected from the set of shapes consisting of: a flat polygonal shape, a wedge, an ellipsoidal shape, a cylinder, and a rectangular solid.

11. The extraction extension of claim 1, wherein a hole, suitable for attachment purposes, is fashioned in the handle.

12. The extraction extension of claim 11, wherein the handle shape is selected from the set of shapes consisting of: a flat polygonal shape, a wedge, an ellipsoidal shape, a cylinder, and a rectangular solid.

13. An extraction extension for ammunition magazines comprising:

a handle, having an extraction end and a fastening end, the fastening end having at least one fastening means and the furthest extremity of the extraction end being defined as the top of the handle, a plurality of hollows being fashioned in the handle, each hollow defining an interior region; and a substitute floor plate, having an obverse and reverse side and at least one anchoring hole, the number of at least one anchoring holes corresponding to the number of fastening means, said hole positioned and sized on the floor plate in a manner to receive the fastening means;

wherein, the handle and floor plate are permanently coupled by the anchoring means being forced through the at least one hole of the floor plate from the obverse side and secured on the reverse side of the floor plate.

14. The extraction extension of claim 13, wherein the handle's anchoring means is at least one anchoring node positioned on the fastening end of said handle.

15. The extraction extension of claim 14, wherein the handle shape is selected from the set of shapes consisting of: a flat polygonal shape, a wedge, an ellipsoidal shape, a cylinder, and a rectangular solid.

16. The extraction extension of claim 14, wherein the interior regions of the hollows are roughened to increase friction.

17. The extraction extension of claim 16, wherein the handle shape is selected from the set of shapes consisting of: a flat polygonal shape, a wedge, an ellipsoidal shape, a cylinder, and a rectangular solid.

18. The extraction extension of claim 16, wherein the handle height measures 1.0 to 1.75 inches.

19. The extraction extension of claim 18, wherein the handle shape is selected from the set of shapes consisting of: a flat polygonal shape, a wedge, an ellipsoidal shape, a cylinder, and a rectangular solid.

20. The extraction extension of claim 18, wherein a hole, suitable for attachment purposes, is fashioned in the handle.

21. The extraction extension of claim 20, wherein the handle shape is selected from the set of shapes consisting of: a flat polygonal shape, a wedge, an ellipsoidal shape, a cylinder, and a rectangular solid.

22. The extraction extension of claim 16, wherein a hole, suitable for attachment purposes, is fashioned in the handle.

23. The extraction extension of claim 22, wherein the handle shape is selected from the set of shapes consisting of: a flat polygonal shape, a wedge, an ellipsoidal shape, a cylinder, and a rectangular solid.

24. The extraction extension of claim 14, wherein a hole, suitable for attachment purposes, is fashioned in the handle.

25. The extraction extension of claim 24, wherein the handle shape is selected from the set of shapes consisting of: a flat polygonal shape, a wedge, an ellipsoidal shape, a cylinder, and a rectangular solid.

26. An extraction extension for ammunition magazines comprising:

a handle, having an extraction end and a fastening end, the fastening end having at least one fastening means and the furthest extremity of the extraction end being defined as the top of the handle, the handle having a hole fashioned within, said hole being suitable for attachment purposes; and a substitute floor plate, having an obverse and reverse side and at least one anchoring hole, the number of at least one anchoring holes corresponding to the number of fastening means, said hole positioned and sized on the floor plate in a manner to receive the fastening means;

wherein, the handle and floor plate are permanently coupled by the anchoring means being forced through the at least one hole of the floor plate from the obverse side and secured on the reverse side of the floor plate.

27. The extraction extension of claim 26, wherein the handle's anchoring means is at least one anchoring node positioned on the fastening end of said handle.

28. The extraction extension of claim 27, wherein the handle shape is selected from the set of shapes consisting of: a flat polygonal shape, a wedge, an ellipsoidal shape, a cylinder, and a rectangular solid.

* * * * *